US012338706B2

(12) United States Patent
Olguin et al.

(10) Patent No.: US 12,338,706 B2
(45) Date of Patent: Jun. 24, 2025

(54) CEMENT PLUG SYSTEM

(71) Applicant: INNOVEX DOWNHOLE SOLUTIONS, INC., Humble, TX (US)

(72) Inventors: Fernando Olguin, Houston, TX (US); Chris Cuffe, The Woodlands, TX (US)

(73) Assignee: INNOVEX DOWNHOLE SOLUTIONS, INC., Humble, TX (US)

( * ) Notice: Subject to any disclaimer, the term of this patent is extended or adjusted under 35 U.S.C. 154(b) by 0 days.

(21) Appl. No.: 18/679,652

(22) Filed: May 31, 2024

(65) Prior Publication Data

US 2025/0003308 A1 Jan. 2, 2025

Related U.S. Application Data

(60) Provisional application No. 63/511,310, filed on Jun. 30, 2023.

(51) Int. Cl.
*E21B 33/12* (2006.01)

(52) U.S. Cl.
CPC ..... *E21B 33/1208* (2013.01)

(58) Field of Classification Search
CPC ..... E21B 33/1208; E21B 33/16
See application file for complete search history.

(56) References Cited

U.S. PATENT DOCUMENTS 4,624,312 A 11/1986 McMullin
5,722,491 A 3/1998 Sullaway et al.
6,318,472 B1 11/2001 Rogers et al.
6,571,880 B1 * 6/2003 Butterfield, Jr. ..... E21B 34/14 166/374
9,200,499 B2 * 12/2015 Hall ..... E21B 33/12
2010/0294503 A1 11/2010 Laurel et al.
2018/0258731 A1 * 9/2018 Budde ..... E21B 43/10
2022/0364431 A1 11/2022 Glordano

FOREIGN PATENT DOCUMENTS

WO 2012125660 A2 9/2012

OTHER PUBLICATIONS

GB Search and Examination Report dated Nov. 29, 2024, GB Application No. 2408264.6, 5 pages.

* cited by examiner

*Primary Examiner* — Matthew R Buck
(74) *Attorney, Agent, or Firm* — MH2 Technology Law Group, LLP

(57) ABSTRACT

A cement plug system includes a first plug configured to catch a first obstruction member and actuatable from a locked configuration to an unlocked configuration in response to an axial force transmitted to the first plug by the first obstruction member, and a second plug adjacent to the first plug and configured to catch a second obstruction member, the second plug having a pass-through configuration in which the first obstruction member passes through the second plug, and a catching configuration in which the second plug catches the second obstruction member, the first obstruction member is at least as large as the second obstruction member. The second plug actuates from the pass-through configuration to the catching configuration in response to the first plug shifting from the locked configuration to the unlocked configuration, and the first plug in the unlocked configuration separates from the second plug.

21 Claims, 3 Drawing Sheets

CEMENT PLUG SYSTEM

CROSS-REFERENCE TO RELATED APPLICATIONS

This application claims priority to U.S. Provisional Patent Application No. 63/511,310, filed on Jun. 30, 2023, which is incorporated by reference.

BACKGROUND

In oil and gas well construction, oilfield tubulars, such as casing, are often deployed into a well and cemented in place. Cement plugs are used for such cementing operations. Generally, a bottom plug is deployed into a well and pushed to the bottom by a slug of cement. The bottom plug, leading the cement slug, separates the cement from other wellbore fluids, which might otherwise impair the cementing process. A top plug generally follows the cement slug, pushing the cement slug downwards, and through the bottom of the oilfield tubular and back upwards into the annulus between the oilfield tubular and the wellbore.

In certain subsea applications, and potentially other applications, a system of two or more plugs may be deployed, before the cement, and hung in place using a hanger, e.g., at or near the wellhead. The plugs are generally hollow, permitting access to the wellbore below, until such time as a dart or another obstruction is deployed into the bottom plug. The bottom plug is then released, and cement is pumped through the top plug. Another obstruction may then be deployed into the top plug, the top plug is then released from the plug hanger, and the cement is pumped down into the well, between the top and bottom plugs.

The provision of two or more plugs generally calls for the use of progressively larger obstruction members. That is, in a two-plug system, a smaller obstruction member is used to pass through the top plug, and a larger obstruction member is then used to close the top plug. This can present challenges and introduces the potential for error, as inadvertently deploying the larger plug first can result in blocking access to the bottom plug and preventing timely cement deployment.

SUMMARY

An example of a cement plug system is provided. The system includes a first plug comprising a first seat configured to catch a first obstruction member, the first plug having a locked configuration and an unlocked configuration, the first plug being actuatable from the locked configuration to the unlocked configuration in response to an axial force transmitted to the first plug by the first obstruction member, and a second plug positioned axially adjacent to the first plug and defining a second seat configured to catch a second obstruction member, the second plug having a pass-through configuration in which the second plug permits the first obstruction member to pass therethrough to the first plug, and a catching configuration in which the second seat is configured to catch the second obstruction member, the first obstruction member having a radial dimension that is at least as large as a radial dimension of the second obstruction member. The second plug is configured to actuate from the pass-through configuration to the catching configuration in response to the first plug shifting from the locked configuration to the unlocked configuration, and wherein the first plug in the unlocked configuration is configured to separate from the second plug.

An example of a method is provided. The method includes deploying, into a well, a first obstruction member to a first seat of a first plug through a second seat of a second plug, the second plug being in a pass-through configuration, and the first plug being in a locked configuration, increasing a pressure in the well, wherein increasing the pressure in the well causes the first plug to actuate into an unlocked configuration, which releases a shifting sleeve to press a second seat of the second plug radially inwards such that the second plug is actuated to a catching configuration, and deploying, into the well, a second obstruction member that is not larger in radial dimension than the first obstruction member. The second seat of the second plug in the catching configuration catches the second obstruction member.

An example of a cement plug system is provided. The cement plug system includes a first plug having a first seat configured to catch a first obstruction member, and a second plug positioned axially adjacent to the first plug and defining a second seat configured to catch a second obstruction member, the second plug having a pass-through configuration in which the second plug permits the first obstruction member to pass therethrough to the first plug, and a catching configuration in which the second seat is configured to catch the second obstruction member, the first obstruction member having a radial dimension that is at least as large as a radial dimension of the second obstruction member. The first plug is actuatable from a locked configuration to an unlocked configuration in response to the first obstruction member being caught in the first seat, and wherein the first plug in the unlocked configuration is configured to separate from the second plug.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
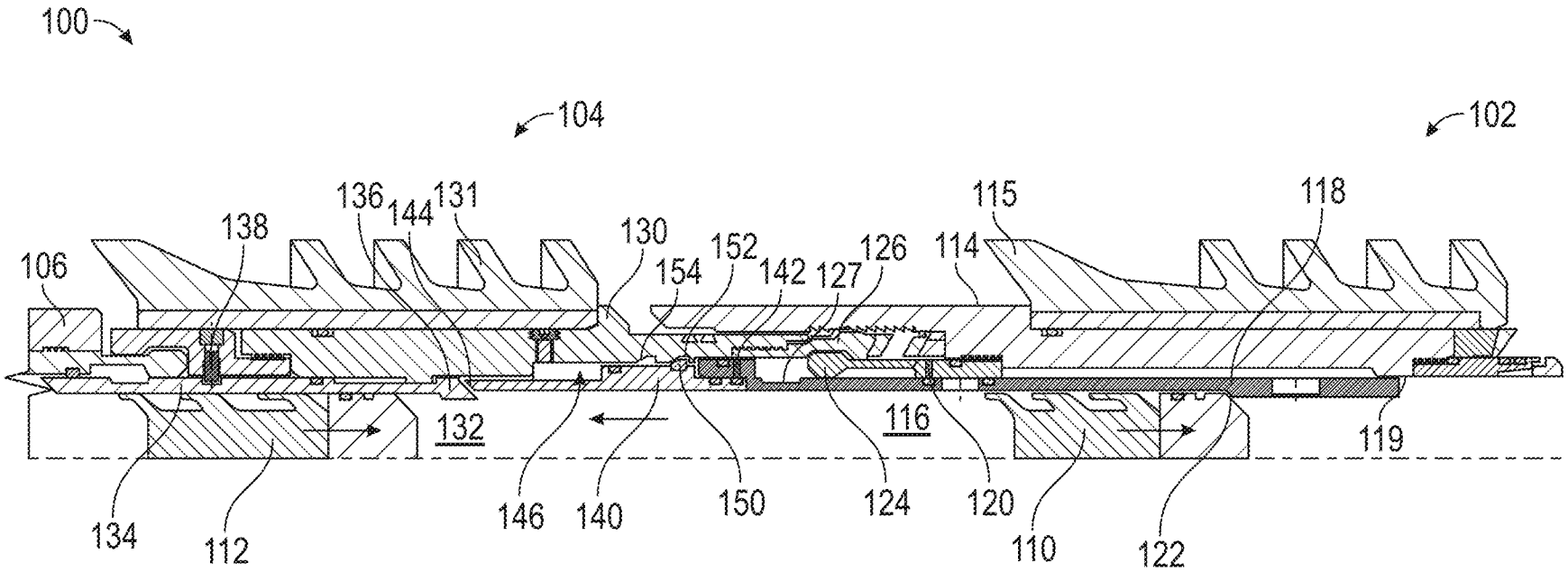
FIG. 1 illustrates a side, half, cross-sectional view of a cement plug system, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, half, cross-sectional view of a cement plug system 100, according to an embodiment. The cement plug system 100 may be configured to support a wellbore cementing operation, in which cement is deployed to an annular region, e.g., radially between a wellbore tubular and the wellbore itself. The cement plug system 100 may generally include a first or "bottom" plug 102 and a second or "top" plug 104, which may be initially coupled together and hung from a plug hanger 106 near a wellhead. The first plug 102 may be configured to catch a first obstruction member (e.g., a dart, ball, etc.) 110, after the first obstruction member 110 passes through the second plug 104. The second plug 104 may be configured to actuate from a pass-through configuration that permits the first obstruction member 110 to pass therethrough to a catching configuration, in which the second plug 104 is able to catch a second obstruction member 112. The second obstruction member 112 may be approximately the same radial dimension (e.g., diameter) as the first obstruction member 110, as thus would have passed through the second plug 104 in the pass-through configuration, but is caught by the second plug 104 in the catching configuration.

The first plug 102 may define a first plug body 114 having wiper fins 115 extending radially therefrom and configured to press against the inside of a wellbore tubular, e.g., to seal therewith. The first plug body 114 may be hollow, defining a bore 116 therethrough. A first sleeve 118 may be positioned at least partially within the first plug body 114 and may be slidable with respect thereto. The first plug body 114 and the first sleeve 118 may be prevented from relative rotation by a morse taper 119 or another structure.

In at least some embodiments, the first sleeve 118 may initially be pinned or otherwise fastened to the first plug body 114 by one or more shearable members 120. The shearable members 120 may be configured to shear and thereby release the first sleeve 118 to move axially with respect to the first plug body 114 in response to application of a predetermined axial force on the first sleeve 118.

The first sleeve 118 may also define a first seat 122 therein. In some embodiments, the first sleeve 118 may be integral with the rest of the first sleeve 118, but in other embodiments, may be another structure that is connected to the first sleeve 118. The first seat 122 may be sized to receive and catch the first obstruction member 110, such that a pressure differential across the first obstruction member 110 may develop, which results in application of an axial force on the first sleeve 118.

A latching member 124 may be coupled to the first plug body 114 and may be configured to releasable secure the first plug 102 to the second plug 104. The latching member 124 may be or include a collet. In the illustrated embodiment, the latching member 124 may be initially entrained in a latching sleeve 126 of the second plug 104 and held in place by the first sleeve 118. The first sleeve 118 may define a recess 127 that is initially offset axially from the latching member 124. When the first sleeve 118 shifts, as will be described in greater detail below, the recess 127 is brought into alignment with the latching member 124, permitting the latching member 124 to deflected radially inwards and release from the latching sleeve 126.

The second plug 104 may include a second plug body 130 having wiper fins 131 extending therefrom and configured to press against a wellbore tubular, e.g., forming a seal therewith. The second plug body 130 may be hollow, defining a bore 132 therethrough. A second sleeve 134 may be positioned within the second plug body 130 and may be configured to slide axially therein, responsive to an axial force applied thereto. The second sleeve 134 may include a second seat 136, which may be integral therewith or a separate structure that is coupled thereto. In at least some embodiments, the second seat 136 may be a collet or a c-ring, such that the second seat is able to be pressed radially inward and thereby reduced in radial dimension.

The second sleeve 134 may initially be restrained from movement relative to the second plug body 130 by one or more shearable members 138. Upon application of a predetermined axial force, the shearable members 138 may shear and release the second sleeve 134 to move axially relative to the second plug body 130.

A shifting sleeve 140 is positioned at least partially in the second plug body 130 and is initially connected to the first sleeve 118 of the first plug 102. For example, the shifting sleeve 140 may be sealed with the first sleeve 118 and may be releasably coupled thereto via one or more shearable members 142. An axial end 144 of the shifting sleeve 140 may be initially engaged with or separated axially apart from the second seat 136. The axial end 144 may be configured to wedge radially between the second plug body 130 and the second seat 136, such that axial movement of the shifting sleeve 140 toward the second seat 136 presses the second seat 136 radially inwards.

A pressurized chamber 146 may be defined axially and radially between the second plug body 130 and the shifting sleeve 140. The pressurized chamber 146 may be prevented from communicating with fluid in the bore 132 and may be held at a relatively low pressure, e.g., atmospheric pressure.

A one-way locking mechanism may be provided for permitting the shifting sleeve 140 to move toward the second seat 136 but preventing reverse travel of the shifting sleeve 140. For example, a tapered ratchet ring 150 and two or more tapered grooves 152, 154 may be employed. As shown, the grooves 152, 154 may be formed in the second plug body 130, but, in other embodiments, may be formed in the shifting sleeve 140. The ratchet ring 150 may initially be in the groove 152. Upon application of a radially upward force (toward the left in FIG. 1) on the shifting sleeve 140, the tapered ratchet ring 150 may be wedged inwards until it comes out of the tapered groove 152, permitting the shifting sleeve 140 to move axially toward the second seat 136. The ratchet ring 150 may eventually fall into the groove 154, and the non-tapered, back sides of the groove 154 and the ratchet ring 150 may prevent the shifting sleeve 140 from reverse travel away from the second seat 136. In at least some embodiments, the ratchet ring 150 may be provided by two or more lugs. In at least some embodiments, the ratchet ring 150 may be a snap ring.

The first and second plugs 102, 104 may initially be coupled together, as shown. In particular, as shown, the second plug 104 may be in a "pass-through" configuration, in which the second seat 136 permits the first obstruction member 110 to pass therethrough and reach the first seat 122 of the first plug 102. The first plug 102 is in a locked configuration, in which the first plug 102 prevents decoupling of the first and second plugs 102, 104. More particularly, the first sleeve 118 prevents the latching member 124 from releasing from the latching sleeve 126.

Upon deployment of the first obstruction member 110, with the second plug 104 in the pass-through configuration, the first obstruction member 110 may land in the first seat 122, thereby sealing the bore 116. A pressure differential may thus develop across the first obstruction member 110, which may exert an axial-directed force thereon that is transmitted to the first sleeve 118. This hydraulically-generated force may eventually reach a predetermined level, which may actuate the first plug 102 from the locked configuration to an unlocked configuration. In particular, as an example, the shearable members 120 and/or 142 may yield under the axial load, releasing the first sleeve 118 to slide axially relative to the first plug body 114. The axial load may be directed downhole (toward the right in FIG. 1), and thus the first sleeve 118 may slide away from the first plug 102. This may result in the recess 127 aligning with the latching member 124, permitting the latching member 124 to deflect radially inward and decouple from the latching sleeve 126. Accordingly, the first and second plugs 102, 104 may be disconnected, permitting the entirety of the first plug 102 to move downhole, away from the second plug 104.

In addition to permitting the first plug 102 to decouple and separate from the second plug 104, actuating the first plug 102 into the unlocked configuration may also permit the second plug 104 to be actuated from the pass-through configuration to a "catching" configuration. In the catching configuration, the second plug 104 is configured to catch the second obstruction member 112. More particularly, the shifting sleeve 140 may no longer be restrained by the first sleeve 118. Further, pressure in the bore 132 may be substantially higher than the pressure (e.g., atmospheric) in the pressurized chamber 146. Accordingly, this pressure differential may hydraulically force the shifting sleeve 140 toward the second seat 136, as the volume in the pressurized chamber 146 is decreased by the shifting sleeve 140 moving. As this occurs, the axial end 144 wedges radially between the second plug body 130 and the second seat 136, pressing the second seat 136 radially inward. Further, the one-way locking mechanism (e.g., the ratchet ring 150 and grooves 152, 154) may prevent the shifting sleeve 140 from backing out of engagement with the second seat 136, thereby locking the second seat 136 in the pressed-inward position. Accordingly, the now radially-smaller second seat 136 may be sized to catch the second obstruction member 112, e.g., the second plug 104 is in the catching configuration.

When the second plug 104 is in the catching configuration, the second obstruction member 112 may form a seal with the second sleeve 134, permitting a pressure differential to develop across the second obstruction member 112. Such pressure differential may generate a force that is transmitted to the second sleeve 134. When this force reaches a predetermined level, the shearable members 138 holding the second sleeve 134 in position relative to the second plug body 130 may yield, permitting the second sleeve 134 to move axially relative to the second plug body 130. The second sleeve 134 may then move axially in a downhole direction (toward the right in FIG. 1), which may release the second plug 104 from the plug hanger 106. The second plug 104 may then proceed in a downhole direction, away from the plug hanger 106.

Figure 2:
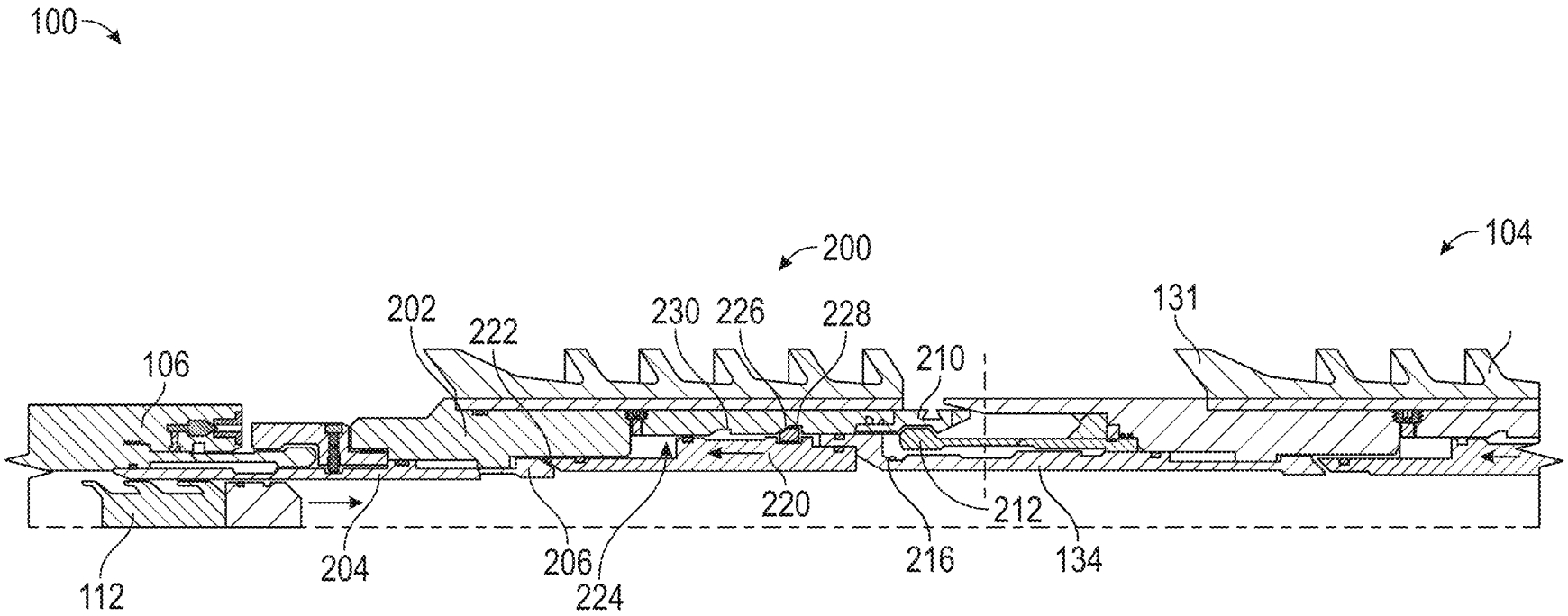
FIG. 2 illustrates a side, half, cross-sectional view of a portion of another embodiment of the cement plug system.

FIG. 2 illustrates a side, cross-sectional view of a portion of another embodiment of the cement plug system 100. In this embodiment, a third plug 200 is interposed between the second plug 104 and the plug hanger 106. The third plug 200 may be similar to the second plug 104, having a pass-through configuration that permits the first and second obstruction members 110, 112 (e.g., FIG. 1) to pass therethrough, and a catching configuration configured to catch a third obstruction member having at most a same radial dimension as the first and/or second obstruction members 110, 112.

In this embodiment, the third plug 200 includes a third plug body 202 and a third sleeve 204 positioned therein. A third seat 206 is coupled to or integrally formed with the third sleeve 204, and is provided, e.g., as a collet or a c-ring, such that the third seat 206 may reduce in radial dimension. Further, the third plug body 202 includes a receiving sleeve 210 that receives a latching member 212 (e.g., a collet) of the second plug 104. The second sleeve 134, in this embodiment, includes a recess 216 that is initially offset from the latching member 212, but is brought into alignment therewith by axial movement of the second sleeve 134 when the second plug 104 is actuated into the catching configuration.

A second shifting sleeve 220 is positioned axially between the third seat 206 and the second sleeve 134 and is engaged with the second sleeve 134. In at least some embodiments, one or more shearable members may connect together the second sleeve 134 and the second shifting sleeve 220. An axial end 222 of the second shifting sleeve 220 may be configured to wedge between the third seat 206 and the third plug body 202, so as to press the third seat 206 radially inwards.

A second pressurized chamber 224 may be defined radially between the third plug body 202 and the second shifting sleeve 220. The second pressurized chamber 224 may be held at a relatively low pressure, e.g., atmospheric, as compared to the higher pressure in the wellbore. A second locking mechanism may also be provided, e.g., as a combination of a tapered ratchet ring 226 and two (or more) tapered grooves 228, 230, which may permit the second shifting sleeve 220 to move axially toward the third seat 206 but prevent reverse travel of the second shifting sleeve 220 away from the third seat 206.

Accordingly, in operation, after actuating the second plug 104 to the catching configuration, as described above, the second obstruction member 112 (FIG. 1) may be deployed through the third plug 200 and caught in the second plug 104. The second plug 104 catching the second obstruction member 112 may cause a pressure differential to develop across the second obstruction member 112, which may shift the second sleeve 134 in the downhole direction, away from the second shifting sleeve 220. This may align the recess 216 of the second sleeve 134 with the latching member 212, permitting the latching member 212 to deflect inwards and release from the receiving sleeve 210. Thus, the second plug 104 may be decoupled from the third plug 200 and may separate therefrom.

With the second sleeve 134 released from the second shifting sleeve 220, the pressure difference between the wellbore and the second pressurized chamber 224 may hydraulically force the second shifting sleeve 220 toward the third seat 206, such that the axial end of the second shifting sleeve 220 wedges the third seat 206 radially inwards. The one-way locking mechanism (e.g., the ratchet ring 226 and the grooves 228, 230) may prevent the second shifting sleeve 220 from backing out of engagement with the third seat 206, thereby maintaining the third seat 206 in its reduced radial dimensions position. Accordingly, the third plug 200 has been actuated and is now in the catching configuration. Subsequently, a third obstruction member may be deployed to shift the third sleeve 204, which may release the third plug 200 from the plug hanger 106.

It will be appreciated that any number of plugs may be employed consistent with the cement plug system 100 disclosed herein. Any one or more of these plugs may have a pass-through configuration and a catching configuration and may be releasable from a superposed plug by application of hydraulic force, as discussed for the second and third plugs herein. Further, any one or more of these plugs may not have a pass-through configuration but may initially be configured to receive an obstruction therein, e.g., as described for the first plug herein.

Figure 3:
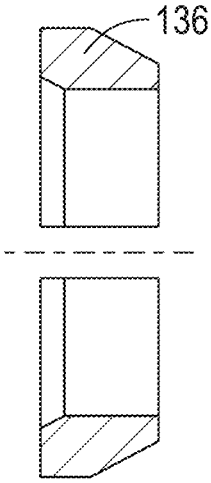
FIG. 3 illustrates a side view of a seat of the cement plug system, according to an embodiment.

FIG. 3 illustrates a cross-sectional view of the second seat 136, according to an embodiment. As noted above, the second seat 136 may be a collet, as depicted in FIGS. 1 and 2, but may also be a c-ring, as shown in FIG. 3. Likewise, the third seat 206 may be a collet or c-ring.

Figure 4:
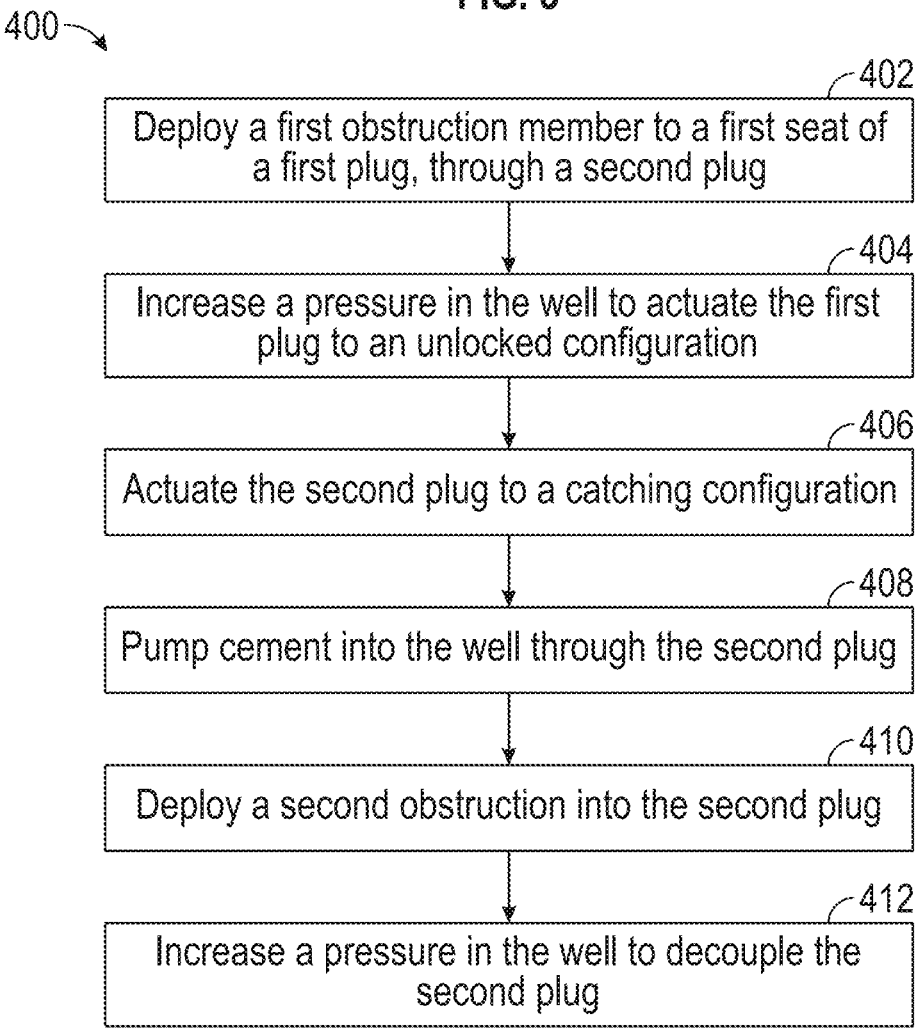
FIG. 4 illustrates a flowchart of a method for operating a cement plug system, according to an embodiment.

FIG. 4 illustrates a flowchart of a method 400 for operating a cement plug system, according to an embodiment. The method 400 may employ one or more embodiments of the cement plug system 100, e.g., as discussed above, and is thus described herein with reference to FIGS. 1 and 2 as a matter of convenience. In other embodiments, the method 400 may employ other structures or devices and thus should not be considered limited to any particular cement plug system unless otherwise stated herein. An illustrative order of the method 400 is provided below; however, one or more steps of the method 400 may be performed in a different order, simultaneously, repeated, or omitted.

The method 400 may include deploying a first obstruction member 110 to a first seat 122 of a first plug 102, as at 402. The first obstruction member 110 may pass through at least one plug (e.g., a second plug 104) that is superposed with respect to (i.e., above) the first plug 102 in the well. The superposed second plug 104 may initially be in a pass-through configuration that permits the first obstruction member 110 to pass therethrough.

The method 400 may then include increasing a pressure above the first obstruction member 110, so as to actuate the first plug 102 from a locked configuration to an unlocked configuration, as at 404. Such actuation may proceed by the pressure above the first obstruction member 110 generating a force on a first sleeve 118 that provides the first seat 122. This force may reach a predetermined level, causing shearable members (e.g., shearable members 120) to release the first sleeve 118 from a first plug body 114. The first sleeve 118 may then move axially in a downhole direction, which unlocks a latching member 124, resulting in the first plug 102 being separable from the second plug 104 (e.g., the first plug 102 is actuated to the unlocked configuration). In at least some embodiments, the actuation from locked to unlocked configurations may not include application of mechanical force, but by hydraulic pressure differential.

With the first plug 102 decoupled from the second plug 104, the second plug 104 may actuate from the pass-through configuration to a catching configuration, as at 406. For example, a pressure differential between pressure in the wellbore and a pressurized chamber 146 may hydraulically force a shifting sleeve 140 toward a second seat 136 of the second plug 104. The shifting sleeve 140 may press the second seat 136 radially inwards, such that the second seat 136 is smaller in radial dimension. Further, a locking mechanism may be configured to prevent the shifting sleeve 140 from sliding away from the second seat 136. Accordingly, the shifting sleeve 140 may be moved by hydraulic forces and not by mechanical application of force (e.g., using a shifting tool), in at least some embodiments.

Cement may then be pumped through the second plug 104 to the first plug 102, pushing the first plug 102 into the well, as at 408.

A second obstruction member 112 may then be deployed into the second plug 104, as at 410. The second plug 104 in the pass-through configuration would permit the second obstruction member 112 to pass therethrough, because the second obstruction member 112 may not be larger than the first obstruction member 110. However, with the second plug 104 in the catching configuration, that is, having its second seat 136 pressed inward to a relatively small radial dimension, the second seat 136 may catch the second obstruction member 112.

Pressure may be increased in the well, as at 412. This may create a pressure differential across the second obstruction member 112 caught in the second seat 136. The pressure may eventually generate an axial force at a predetermined level that causes shearable members 138 to shear, releasing the second sleeve 134 from the second plug body 130. This may permit the second sleeve 134 to shift in an axial direction, which may permit the second plug 104 to release from a superposed plug (e.g., the third plug 200 of FIG. 2) or from the hanger 106 (e.g., as in the embodiment of FIG. 1). If there are one or more plugs between the second plug 104 and the hanger 106 (e.g., the third plug 200 of FIG. 2), the process of deploying an obstruction member and increasing the pressure may be repeated to actuate/release the superposed plug(s).

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A cement plug system, comprising:

a first plug comprising a first seat configured to catch a first obstruction member, the first plug having a locked configuration and an unlocked configuration, the first plug being actuatable from the locked configuration to the unlocked configuration in response to an axial force transmitted to the first plug by the first obstruction member; and a second plug positioned axially adjacent to the first plug and defining a second seat configured to catch a second obstruction member, the second plug having a pass-through configuration in which the second plug permits the first obstruction member to pass therethrough to the first plug, and a catching configuration in which the second seat is configured to catch the second obstruction member, the first obstruction member having a radial dimension that is at least as large as a radial dimension of the second obstruction member, wherein the second plug is configured to actuate from the pass-through configuration to the catching configuration in response to the first plug shifting from the locked configuration to the unlocked configuration, and wherein the first plug in the unlocked configuration is configured to separate from the second plug.

2. The system of claim 1, wherein the second seat comprises a collet or a c-ring having an internal diameter that decreases when the second plug actuates from the pass-through configuration to the catching configuration.

3. The system of claim 1, wherein the first plug comprises a first plug body and a first sleeve positioned therein, wherein the first sleeve comprises the first seat, and wherein the first plug actuating from the locked configuration to the unlocked configuration comprises the first sleeve shifting axially away from the second plug.

4. The system of claim 3, wherein the first sleeve is configured to shift in response to a force applied to the first obstruction member that is caught in the first seat.

5. The system of claim 4, wherein the first sleeve shifting decouples the first plug body from the second plug, and wherein the second plug is superposed with respect to the first plug.

6. The system of claim 3, wherein the second plug comprises:

a second plug body and a second sleeve positioned therein, the second sleeve comprising the second seat; and a shifting sleeve positioned in the second plug body and engaged with the first sleeve and the second plug body when the first plug is in the locked configuration, wherein the shifting sleeve is configured to shift toward the second sleeve to actuate the first second plug from the pass-through configuration to the catching configuration.

7. The system of claim 6, wherein the shifting sleeve is shifted by application of a pressure differential.

8. The system of claim 7, wherein the second plug defines a pressurized chamber axially between the second plug body and the shifting sleeve, and wherein the shifting sleeve shifting when the second plug actuates from the pass-through configuration to the catching configuration comprises the shifting sleeve reducing a volume of the pressurized chamber.

9. The system of claim 6, wherein the second plug comprises a locking mechanism that permits the shifting sleeve to shift toward the second seat and prevents the shifting sleeve from shifting away from the second seat.

10. The system of claim 6, wherein an axial end of the shifting sleeve engages the second seat, and wherein the shifting sleeve shifting when the first second plug actuates from the pass-through configuration to the catching configuration comprises the axial end of the shifting sleeve wedging between the second plug body and the second seat, thereby pressing the second seat radially inwards.

11. The system of claim 6, wherein the first plug comprises a latching member that is connected to the first plug body and the second plug body, wherein the first sleeve prevents the latching member from disconnecting from the second plug body when the first plug is in the locked configuration, and wherein the first sleeve permits the latching member to disconnect from the second plug body when the first plug is in the unlocked configuration.

12. The system of claim 3, wherein the first plug comprises one or more shearable members that prevent the first plug from actuating until a predetermined axial force is applied to the first sleeve.

13. The system of claim 1, further comprising a third plug positioned axially adjacent to the second plug, the third plug being configured to actuate from a pass-through configuration to a catching configuration, wherein the third plug in the pass-through configuration permits the first and second obstruction members to pass therethrough, and wherein the third plug in the catching configuration is configured to catch a third obstruction member having at most a same radial dimension as the first obstruction member.

14. A method for operating a cement plug system in a well, the method comprising:

deploying, into the well, a first obstruction member to a first seat of a first plug through a second seat of a second plug, the second plug being in a pass-through configuration, and the first plug being in a locked configuration;

increasing a pressure in the well, wherein increasing the pressure in the well causes the first plug to actuate into an unlocked configuration, which releases a shifting sleeve to press a second seat of the second plug radially inwards such that the second plug is actuated to a catching configuration; and deploying, into the well, a second obstruction member that is not larger in radial dimension than the first obstruction member, wherein the second seat of the second plug in the catching configuration catches the second obstruction member.

15. The method of claim 14, further comprising increasing the pressure in the well after deploying the second obstruction member, which causes the second plug to decouple from a plug hanger or from a superposed plug.

16. The method of claim 14, wherein a pressure differential between the well and a pressurized chamber formed between a second plug body of the second plug and the shifting sleeve causes the shifting sleeve to press the second seat radially inwards.

17. The method of claim 14, further comprising pumping cement into the well through the second plug after deploying the first obstruction member to the first plug, wherein pumping the cement causes the first plug to move downhole away from the second plug.

18. The method of claim 14, wherein the first plug to actuating into the unlocked configuration comprises releasing a first sleeve of the first plug to move axially relative to a first plug body of the first plug and releasing the shifting sleeve from the first sleeve.

19. The method of claim 14, wherein the second obstruction member is deployed through a third plug in a pass-through configuration, the method further comprising increasing a pressure in the well after deploying the second obstruction member, which causes the second plug to decouple from the third plug, and causes the third plug to actuate to a catching configuration.

20. The method of claim 19, further comprising deploying a third obstruction member into a third seat of the third plug in the catching configuration and increasing a pressure in the well, which causes the third plug to release from a plug hanger.

21. A cement plug system, comprising:

a first plug comprising a first seat configured to catch a first obstruction member; and a second plug positioned axially adjacent to the first plug and defining a second seat configured to catch a second obstruction member, the second plug having a pass-through configuration in which the second plug permits the first obstruction member to pass therethrough to the first plug, and a catching configuration in which the second seat is configured to catch the second obstruction member, the first obstruction member having a radial dimension that is at least as large as a radial dimension of the second obstruction member, wherein the first plug is actuatable from a locked configuration to an unlocked configuration in response to the first obstruction member being caught in the first seat, and wherein the first plug in the unlocked configuration is configured to separate from the second plug.

* * * * *